United States Patent [19]

Moraw et al.

[11] 4,202,693

[45] May 13, 1980

[54] RECORDING MATERIAL HAVING INTERSECTING CONDUCTIVE STRIPS AND APERTURED SPACING MEANS

[75] Inventors: Roland Moraw; Günther Schädlich, both of Naurod, Fed. Rep. of Germany

[73] Assignee: Hoechst Aktiengesellschaft, Frankfurt am Main, Fed. Rep. of Germany

[21] Appl. No.: 719,713

[22] Filed: Sep. 2, 1976

[30] Foreign Application Priority Data

Sep. 5, 1975 [DE] Fed. Rep. of Germany ..... 2539524

[51] Int. Cl.[2] ..... G03G 16/00

[52] U.S. Cl. ..... 430/50; 346/77 E; 430/81; 430/496

[58] Field of Search ..... 96/1.1, 1 E, 1.5; 346/76 R, 77 E; 178/66 TP; 204/18

[56] References Cited

U.S. PATENT DOCUMENTS

| | | | |
|---|---|---|---|
| 3,137,762 | 6/1964 | Baumgartner et al. | 346/77 E |
| 3,158,430 | 11/1964 | McNaney | 346/77 E |
| 3,312,979 | 4/1967 | Torre et al. | 346/76 R |
| 3,466,423 | 9/1969 | Janning | 346/76 |
| 3,764,311 | 10/1973 | Bean | 96/1.1 |
| 3,815,987 | 6/1974 | Duck | 96/1 R |
| 4,021,236 | 5/1977 | Sheridow et al. | 96/1.5 |

FOREIGN PATENT DOCUMENTS

| | | | |
|---|---|---|---|
| 2335230 | 1/1975 | Fed. Rep. of Germany | 96/1.1 |

*Primary Examiner*—Mary F. Kelley
*Assistant Examiner*—John L. Goodrow
*Attorney, Agent, or Firm*—Schwartz, Jeffery, Schwaab, Mack, Blumenthal & Koch

[57] ABSTRACT

Disclosed is a recording material comprising a first transparent, dielectric support member having on one surface thereof a plurality of first elongated, electrically conductive regions extending adjacent one another in spaced relationship; a layer comprising a photo-conductive, thermoplastic material adjacent to, but spaced from, the surface of the first support member; and a second transparent dielectric support member positioned contiguous to the photo-conductive layer on the side opposite the first support member, the second support member having on the surface thereof adjacent the photo-conductive layer a plurality of second elongated, electrically conductive regions extending adjacent one another in spaced relationship, the longitudinal axis of each of the second elongated, electrically conductive regions extending generally transversely to the longitudinal axis of each of the first elongated, electrically conductive regions to form cross-over regions.

13 Claims, 3 Drawing Figures

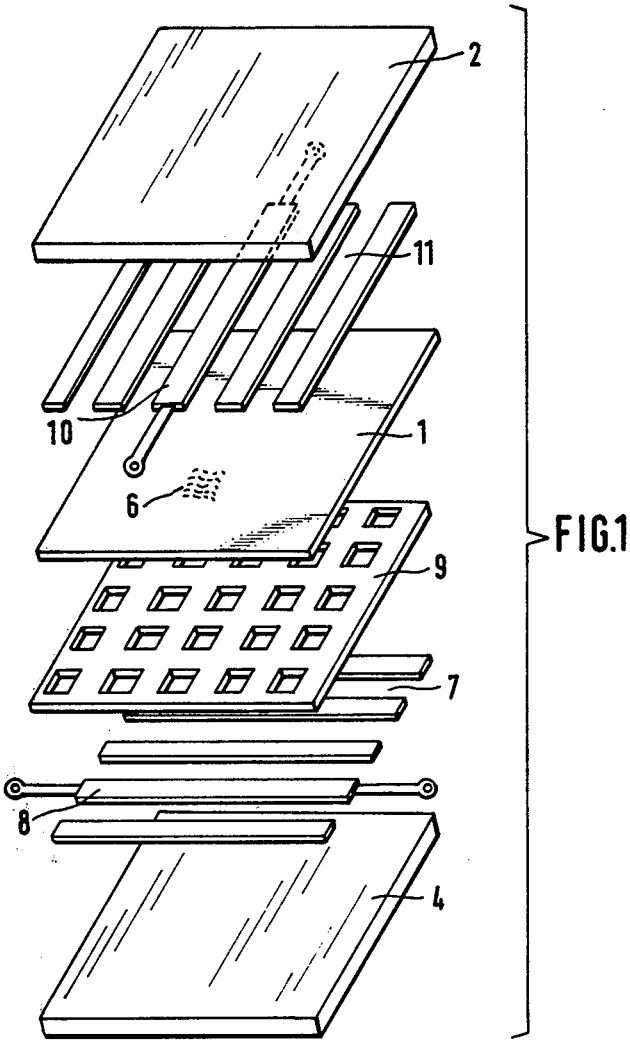
FIG.1
FIG.2
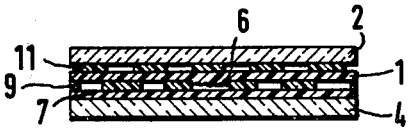
FIG.3
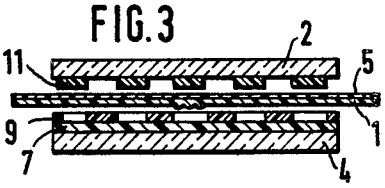

RECORDING MATERIAL HAVING INTERSECTING CONDUCTIVE STRIPS AND APERTURED SPACING MEANS

BACKGROUND OF THE INVENTION

The present invention relates to a recording material on which there may be produced locally-defined deformation images.

German Offenlegungsschrift No. 2,335,230 discloses a recording material comprising a thermoplastic photoconductive layer disposed on a layer of two intersecting, electrically insulated grids of low-resistance, electrically conductive material, the grids being disposed on a transparent, dielectric support.

The use of intersecting grids has also been suggested for heat sensitive recording materials (see U.S. Pat. No. 3,312,979) in which individual point regions of the material are changed in color, by producing increases in temperature whereby, for example, graphic representations can be produced by selecting appropriate points to be so changed.

However, the commercial production of such recording materials by application of the various layers one after the other on a support is technically expensive and complicated. Since a failure point in the conductive grids can render useless the entire recording material, these materials are, in addition, susceptible to breakdown.

SUMMARY OF THE INVENTION

It is an object of the present invention to produce a recording material for the locally-defined production or erasure of deformation images in which the above-described disadvantages can largely be overcome.

It is also an object of the invention to provide such an improved recording material in connection with which, as a result of a simplified method of production and recording technique, it is possible for good quality deformation images, especially holograms, to be produced, erased or corrected.

A particular object of the invention is to provide for avoidance as far as possible of the electrical flash-overs which occur when using a needle corona charging device since, in cyclic operations on a given recording material, such flash-overs produce permanent, undesired failure points.

The foregoing objects have been accomplished by providing according to the present invention a recording material comprising: a first transparent, dielectric support member having on one surface thereof a plurality of first elongated, electrically conductive regions extending adjacent one another in spaced relationship; a layer comprising a photo-conductive, thermoplastic material adjacent to, but spaced from, the surface of the first support member; and a second transparent dielectric support member positioned contiguous to the photo-conductive layer on the side opposite the first support member, the second support member having on the surface thereof adjacent the photo-conductive layer a plurality of second elongated, electrically conductive regions extending adjacent one another in spaced relationship, the longitudinal axis of each of the second elongated, electrically conductive regions extending generally transversely to the longitudinal axis of each of the first elongated, electrically conductive regions to form cross-over regions.

The angle of intersection between the first and second elongated conductive regions is generally between about 40° and 135°.

In a preferred embodiment the recording material according to the invention consists of a compact structural unit which can be used and inter-changed as such.

The recording material of the invention has the advantage over prior materials that, for its production, it is not necessary for two electrically conductive grids and an insulating intermediate layer to be applied to the support. On the contrary, it is sufficient to apply to the support only one grid of electrically conductive, low resistance regions, which grid can be used on both sides of the recording material of the invention. Therefore, considerably simplified production control and easier detection of defective supports are rendered possible.

In addition, the recording material has the advantage that when the photo-thermoplastic recording layer becomes worn it is not necessary, as it has been hitherto, to throw away the support with the expensive system of intersecting conductive grids. Instead, after disassembling the structural unit, only one support with its simple arrangement of conductive regions thereon need to be exchanged according to the embodiment where this support carries the thermoplastic recording layer.

It has also been shown that in cyclic operation, as a result of the sandwich-type arrangement, there is no interference caused by dust depositing on the thermoplastic layer. Experience has shown that in the case of an exposed surface the largely triboelectrically charged dust deposits on the charged recording layer and is irreversibly fused into the layer during the thermal treatment, which in this type of recording becomes progressively more troublesome with an increasing number of cycles.

Finally, electrostatic charging of the thermoplastic layer may be achieved by applying a voltage across a pair of the conductive regions. Because of the relatively small distance between the pairs of conductive regions, the voltage required to charge the material is smaller than the usual high voltage required for wire or needle corona charging devices. Surprisingly, the number of electrostatic flash-overs is noticeably reduced, which has proved to be an additional advantage, especially during cyclic operation.

The recording material of the invention may be in two or more component parts. In the case of two component parts, one of the parts is preferably designed so that the photo-thermoplastic layer forms one inner surface (i.e., when the material is assembled). This has the advantage of the photoconductive layer being easily inter-changeable.

The thermoplastic recording layer may be supported on a flexible film, in which case it is advantageous for the recording material to be in three component parts.

Further features, objects and advantages of the invention will become apparent from the following detailed description of exemplary, preferred embodiments, when considered in light of the attached figures of drawing.

BRIEF DESCRIPTION OF THE DRAWINGS

In the drawings:

FIG. 1 is an exploded perspective view of a recording material of the invention;

FIG. 2 is a sectional view of the material of FIG. 1 after assembly; and

FIG. 3 is an exploded sectional view of a three component material of the invention.

Referring now to the drawings, a photo-conductive, thermoplastic layer 1 is sandwiched between two support plates 2 and 4 which may comprise, for example, glass. Each plate 2, 4 is coated on its innermost surface with a series of transparent, electrically conductive strips 11 and 7 respectively, the series of strips being electrically insulated from one another. The transparent, conductive strips 7 and 11 may comprise, for example, tin oxide. Coated plates 2 and 4 may be obtained, for example, from the German firm Balzers GmbH., Geisenheim/Rhine, in the dimensions 3×50×50 mm. The ends of the conductive strips 7 and 11 are reinforced with a conductive layer to enable good electrical contact to be made with the individual strips 7 and 11. The surface resistance of the strips 7 and 11 is preferably about 20 ohms/square centimeters. The width of the strips is preferably in the range of from about 1–5 mm, preferably 2–4 mm, and the spacing between the strips is preferably about 1–3 mm, more preferably about 2 mm.

The support plate 4 with the series of conducting strips 7 is covered with an electrically insulative intermediate layer 9 to space it from the photo-thermoplastic layer. The intermediate layer 9 may be in the form of a frame, but as is shown, it is preferably in the form of a perforated plate in which the size of the perforations and the distance between them correspond respectively to the widths of and distances between the conducting strips 7, the perforations coinciding with the cross-over points of the strips 7 and 11. The intermediate layer 9 may comprise a metal film provided that it is electrically insulated from the strips 7. Alternatively, it may comprise a suitably, thickly applied photolacquer layer, for example one known from copying and developing processes. Perforated plastic plates have also proved suitable. In cases where there is required a relatively thick intermediate layer 9, films of up to 2 mm thickness comprising polymethylmethacrylate have proved especially suitable. For relatively thin intermediate layers, films having thicknesses of between 0.2 and 0.015 mm comprising, for example, a polyester are suitable. The layers 4, 7 and 9 preferably constitute one component in a multi-component recording material.

The support plate 2 with its series of conductive strips 11 is covered on the surface carrying the strips 11 with a photo-conductive, thermoplastic recording layer 1. The layer 1 may, for example, be prepared by pouring a solution of 10 g of poly-N-vinyl carbazole and 1.5 g of trinitrofluorenone in 250 ml of tetrahydrofuran onto the conductive support plate 2, while rotating the latter, and then subsequently drying the coated plate for 30 minutes at 60° C. A second solution of a thermoplastic composition, for example, a solution of 4 g of glycerol ester of hydrated colophony in 100 ml of benzine (boiling point 80°–100° C.), is coated onto the dry layer and drying is carried out again. The thicknesses of the above two layers, is preferably about 2 μ and about 0.7 μ, respectively. The recording layer 1 may, of course, comprise other suitable materials.

The layers 2, 11 and 1 may, in the case of a multi-component recording material, constitute one component.

The above-described components comprising the layers 2, 11 and 1 and the layers 4, 7 and 9 may be supplied as separate parts or as a unitary piece. The two components may be firmly joined together by means of an adhesive. However, they must be held together by mechanical means, for example, by clamps. This makes it possible to easily replace the component comprising the layers 2, 11 and 1 when the recording layer 1 becomes worn. In the case of solder contacts between the strips 7 and 11 and power input leads, it is advisable, in order to ensure close, even contact between the two components unhindered by beads of solder, for the support plates 2 and 4 to not be square but instead rectangular, so that the contacts are positioned externally of the overlapping portions of the supports 2 and 4. This also renders the contacts readily accessible.

For recording a hologram, for example, at a predetermined point on the layer 1 of the recording material, the strip 10 is grounded and a voltage of, for example +1500 volts is applied to the strip 8 for a few seconds. This voltage is typical for the case where the intermediate layer 9 comprises a polyester film having a thickness of 100 μm. The holographic exposure is carried out with interfering light from, for example, an He/Ne laser until a radiation energy of, for example, 20 $\mu J/cm^2$ is reached in the recording area. For the thermal development there is simultaneously applied a voltage of, for example, 60 volts, for a period of, for example, 0.15 seconds across each of the conductive strips 10 and 8. A relief image 6 results having a diameter of approximately 2 mm.

A relief image formed using the material of the invention is not appreciably affected by recording one or more further images on an adjacent area of the recording material because the thermal energy produced in the conductive strips can be highly localized. In the above example, in order to erase the relief image, a voltage of 65 volts is applied to each of the conductive strips 10 and 8. By repeating the recording and erasing steps, it is possible to achieve locally defined, cyclic recording.

The voltage for electrostatic charging can be reduced to approximately +1000 volts if the conductive strips 7 and 11 have a grained structure at least over a part of their surfaces. Their marginal zones are advantageously grained in this manner and optionally in addition, the openings in the intermediate layer 9 are made somewhat larger than the areas of the cross-over points of the conductive strips 8 and 10.

In the case where the plates 2 and 4 comprise glass, such a grained structure may be obtained by etching predetermined circular areas of the plates 2 and 4 before the conductive strips are applied, for example by cathode sputtering.

A further increase in the flexibility of the recording material and in the case of exchange of the recording layer 1 may be produced by using a self-supporting recording layer 1 on a support film 5 (see FIG. 3). The finished structural unit comprises in this case the structural element comprising layers 4, 7 and 9, the structural element comprising layers 2 and 11, and disposed therebetween, the recording layer 1 on the carrier film 5, wherein the recording layer 1 faces the series of conductive strips 7. In the case of a support film 5 having a thickness of approximately 50 μm, which is common, the electrostatic charging voltage usually needs to be increased to approximately 6 KV. In order to avoid flash-overs to adjacent conductive strips, precautionary steps may need to be taken, for example, a somewhat greater spacing between adjacent strips, additional insulation or the application of auxiliary electrical potentials.

What is claimed is:

1. A recording material comprising:

(a) a first transparent, dielectric support member having on one surface thereof a plurality of first elongated, electrically conductive strips extending adjacent one another in spaced relationship, (b) a layer comprising a photo-conductive thermoplastic material adjacent to, but spaced from, said surface of said first support member, (c) spacing means interposed between said photo-conductive layer and said first support member for spacing them apart, (d) a second transparent dielectric support member positioned contiguous to said photo-conductive layer on the side opposite said first support member, said second support member having on the surface thereof adjacent said photo-conductive layer a plurality of second elongated, electrically conductive strips extending adjacent one another in spaced relationship, the longitudinal axis of each of said second elongated, electrically conductive strips extending generally transversely to the longitudinal axis of each of said first elongated, electrically conductive strips to form cross-over regions, and (e) said spacing means comprises a layer of an electrically insulative material having a plurality of apertures therein, said apertures coinciding with the cross-over regions between the first elongated conductive strips and the second elongated conductive strips.

2. The recording material as claimed in claim 1, wherein said recording material is of unitary construction.

3. The recording material as claimed in claim 1, comprising two separate components capable of being assembled into a unitary recording material, wherein one of which components comprises said photo-conductive layer as one outermost layer and one of said first and second support members as another outermost layer.

4. The recording material as claimed in claim 1, wherein said photo-conductive layer comprises a layer of photoconductuve thermoplastic material disposed on a support film.

5. The recording material as claimed in claim 4, in the form of three separate components comprising (1) said first support member and said spacing means, (2) said photo-conductive layer, and (3) said second support member, said three components being capable of being assembled into a unitary recording material.

6. The recording material as claimed in claim 1, wherein at least part of the surface of said first and second support members overlaid by the elongated, conductive strips are grained.

7. The recording material as claimed in claim 1, wherein the axis of each of the second elongated conductive strips extend at right angles to the axis of each of the first elongated conductive strips.

8. The recording material as claimed in claim 1, wherein at least one of the support members is comprised of glass.

9. The recording material as claimed in claim 1, wherein said elongated conductive strips comprise tin oxide.

10. The recording material as claimed in claim 1, wherein the photo-conductive, thermoplastic material comprises poly-N-vinyl carbazole and trinitrofluorenone.

11. The recording material as claimed in claim 1, further comprising a thermal deformation image on a portion of said photoconductive layer.

12. A recording material comprising:

(a) a first transparent, dielectric support member having on one surface thereof a plurality of first elongated, transparent, electrically conductive strips extending adjacent one another in spaced relationship, (b) a layer comprising a photo-conductive, thermoplastic material adjacent to, but spaced from, said surface of said first support member, (c) means interposed between said photo-conductive layer and said first support member for spacing them apart, (d) a second transparent dielectric support member positioned contiguous to said photo-conductive layer on the side opposite said first support member, said second support member having on the surface thereof adjacent said photoconductive layer a plurality of second elongated, transparent, electrically conductive strips extending adjacent one another in spaced relationship, the longitudinal axis of each of said second elongated, transparent, electrically conductive strips extending generally transversely to the longitudinal axis of each of said first elongated, transparent, electrically conductive strips to form cross-over regions, and (e) said spacing means comprising a layer of an electrically insulative material having a plurality of apertures therethrough, said apertures positioned coincident with the cross-over regions between said first and second electrically conductive strips.

13. The recording material as claimed in claim 12 wherein said spacing means has apertures of substantially the same size as said cross-over regions.

* * * * *